US005239934A

United States Patent [19]

Miller et al.

[11] Patent Number: 5,239,934

[45] Date of Patent: Aug. 31, 1993

[54] PORTABLE WORK TABLE FOR BEING REMOVABLY POSITIONED WITHIN A STORAGE COMPARTMENT OF A VEHICLE

[76] Inventors: Geoffrey S. Miller, 411 Berkley Rd., Haverford, Pa. 19041; Francis A. Richard, 1045 N. West End Blvd., Box 428, Quakertown, Pa. 18951

[21] Appl. No.: 881,919

[22] Filed: May 12, 1992

[51] Int. Cl.[5] ..... A47B 23/00; B25H 1/12

[52] U.S. Cl. ..... 108/44; 144/285; 144/286 R; 248/188.6; 296/241

[58] Field of Search ..... 144/285, 286 R; 108/44, 108/55.1, 127, 129, 132; 248/188.2, 188.6, 188.8; 296/24.1

[56] References Cited

U.S. PATENT DOCUMENTS

| | | | |
|---|---|---|---|
| 1,063,046 | 5/1913 | Lathrop | 144/285 |
| 1,227,536 | 5/1917 | Hartman . | |
| 1,385,233 | 7/1921 | Stafford | 144/285 |
| 1,525,013 | 2/1925 | Vaaler . | |
| 2,505,658 | 4/1950 | Wilson | 144/285 |
| 2,607,651 | 8/1952 | Preuss | 312/30 |
| 2,786,500 | 3/1957 | Unterfranz | 144/285 |
| 3,152,709 | 10/1964 | Fowler | 214/515 |
| 3,394,666 | 7/1968 | Pearlman | 108/129 |
| 3,628,578 | 12/1971 | Berg | 83/471.3 |
| 4,055,206 | 10/1977 | Griffin | 144/285 |
| 4,335,765 | 6/1982 | Murphy | 144/286 R |
| 4,993,088 | 2/1991 | Chudik | 5/118 |
| 5,090,335 | 2/1992 | Russell | 108/44 |

*Primary Examiner*—W. Donald Bray

*Attorney, Agent, or Firm*—Panitch Schwarze Jacobs & Nadel

[57] ABSTRACT

A portable work table adapted for being removably positioned within a storage compartment of a vehicle includes a frame having an upper wall with a generally planar top surface, side walls extending from the upper wall and a bottom wall extending between the side walls. A plurality of legs are movably mounted on the frame and are movable between a first position such that the legs extend from the bottom surface for being engaged with a support surface such that the frame is positioned above the support surface to permit work to be readily carried out on the top surface and a second position such that the legs are retracted from the first position towards the bottom surface such that the frame is positionable within the storage compartment of the vehicle. A plurality of objects are movably mounted on the frame. A storage device is interconnected between the frame and each of the objects for allowing each object to move with respect to the top surface of the frame between a first position such that the object is positioned within the interior of the frame below the top surface and a second position such that the object is positioned at least partially above the top surface of the frame.

17 Claims, 5 Drawing Sheets

PORTABLE WORK TABLE FOR BEING REMOVABLY POSITIONED WITHIN A STORAGE COMPARTMENT OF A VEHICLE

FIELD OF THE INVENTION

The present invention is directed to a portable work table and, more particularly, to a portable work table adapted for being removably positioned within a storage compartment of a vehicle.

BACKGROUND OF THE INVENTION

It is common for construction workers working on a particular job site to require a work table for performing various tasks associated with the construction. Many times, the worker prefers or is required to use his own tools when working at a particular site. Since a worker may have to work at multiple sites which are located in different geographical areas, a worker's tools and work table must be transportable so that the worker can move equipment from location-to-location.

Many prior art work tables are designed to be carried in a storage compartment of a vehicle, such as a bed of a pickup truck. The table typically comprises a generally planar horizontal surface from which extends two pairs of legs, each pair of legs being located on opposite ends of the table. Typically, the legs are constructed to fold beneath the table so that the table can be placed into the storage compartment of the vehicle and take up a minimum amount of space. Such a table is deficient, however, in that there is no place in which to store tools. Therefore, the table is typically first positioned within the storage bed and then the tools, supplies, etc. are positioned on top of the table during travel. Upon reaching a work site, all of the individual tools must first be removed from the table top to access the table. This increases the time to set up and break down at each work site. Furthermore, since electrical outlets are typically inaccessible at construction sites, a worker may be unable to use power tools on the site.

Other conventional work tables which are to be stored in a storage compartment of a vehicle are problematic in that they only include one pair of legs to support one end of the work table. That is, one end of the work table is typically fixed to the vehicle on sliding tracks or the like, and the other end of the table can be pulled from the storage area to a position externally of the vehicle to be supported by the single pair of legs. This type of conventional work table has a drawback in that the vehicle is secured to the table and cannot be used for any other purpose while work is being carried out on the table. Moreover, this type of table also suffers from the same drawback of not being able to store tools.

Prior art work tables often contain drawers for storing various tools and supplies. However, these tables, like the above-discussed tables, are deficient in that they must be placed proximate to an electrical source in order to allow a worker to use power tools. Furthermore, the drawers do not provide any way of securing the tools from movement during travel. If the tools are not properly secured, the tools can be damaged thereby causing the worker additional expense and aggravation.

There is a need for a work table which is portable and easily carried in the storage compartment of the vehicle. The work table should have multiple compartments for carrying and securing various tools and other supplies. There is also a need for a work table which is completely removable from the vehicle to permit the vehicle to be used for other functions while the work table is in use. In addition, the work table should include a portable generator for supplying electrical power to the tools and a power connection outlet for connecting the various tools to the power source. In addition, the work table should include a way of connecting the power tools to an outside power source, such as an AC main. It would also be useful for the work table to have retractable legs such that when the work table is positioned within the storage compartment of the vehicle, the legs could extend from the top surface thereof in order to allow additional articles to be carried and secured on top of the work table. Such a work table should be easily transported from location-to-location and should contain all the tools and supplies necessary for a worker to efficiently perform a job.

SUMMARY OF THE INVENTION

Briefly stated, the present invention comprises a portable work table adapted for being removably positioned within a storage compartment of a vehicle. The portable work table comprises a frame including an upper wall having a generally planar top surface, side walls extending from the top surface and a bottom wall extending between the side walls. The upper, bottom and side walls define a generally hollow interior. A plurality of legs are movably mounted on the frame. The legs are movable between a first position wherein the legs extend from the bottom wall for being engaged with the support surface such that the frame is positioned above the support surface to permit work to be readily carried out on the top surface and a second position wherein the legs are retracted from the first position toward the bottom wall such hat the frame is positionable within the storage compartment of the vehicle. A plurality of objects are movably mounted on the frame. Storage means, interconnected between the frame and each of the objects, allows each object to move with respect to the top surface of the frame between a first position wherein the object is positioned within the interior of the frame below the top surface and a second position wherein the object is positioned at least partially above the top surface of the frame.

BRIEF DESCRIPTION OF THE DRAWINGS

The foregoing summary, as well as the following detailed description of the preferred embodiment, will be better understood when read in conjunction with the appended drawings. For the purpose of illustrating the invention, there is shown in the drawings an embodiment which is preferably preferred, it being understood, however, that the invention is not limited to the specific methods and instrumentalities disclosed. In the drawings.

DESCRIPTION OF PREFERRED EMBODIMENT

Figure 1:
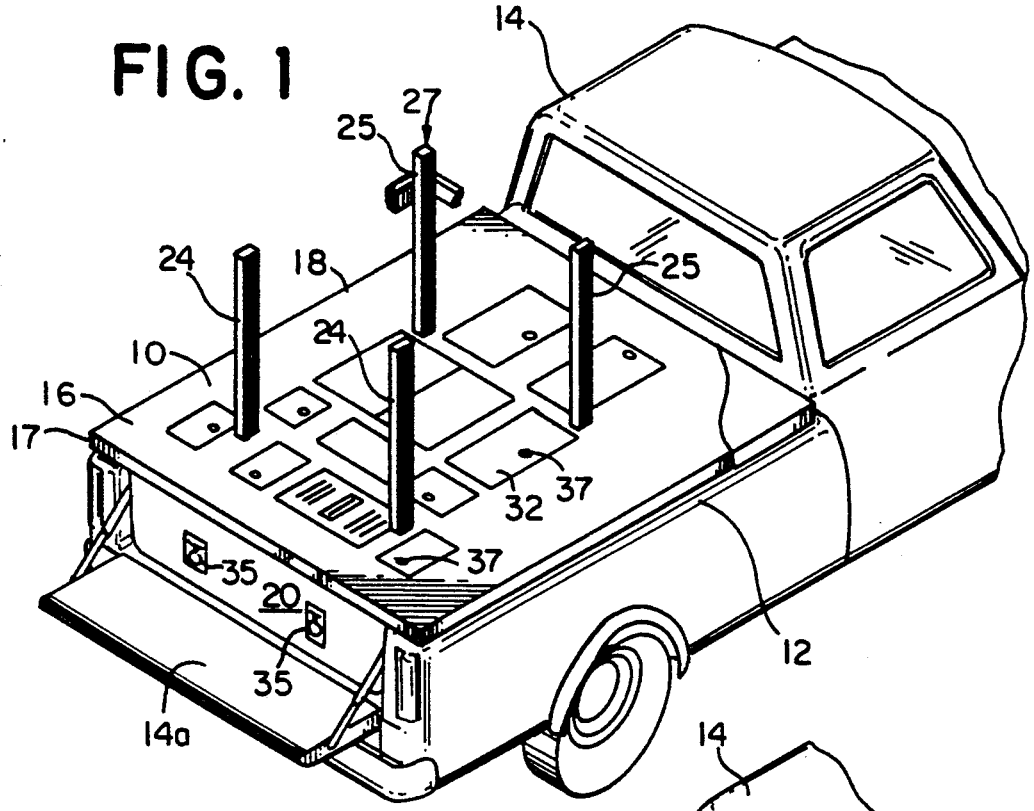
FIG. 1 is a perspective view of a portable work table located within a storage compartment of a vehicle in accordance with the present invention.
Figure 2:
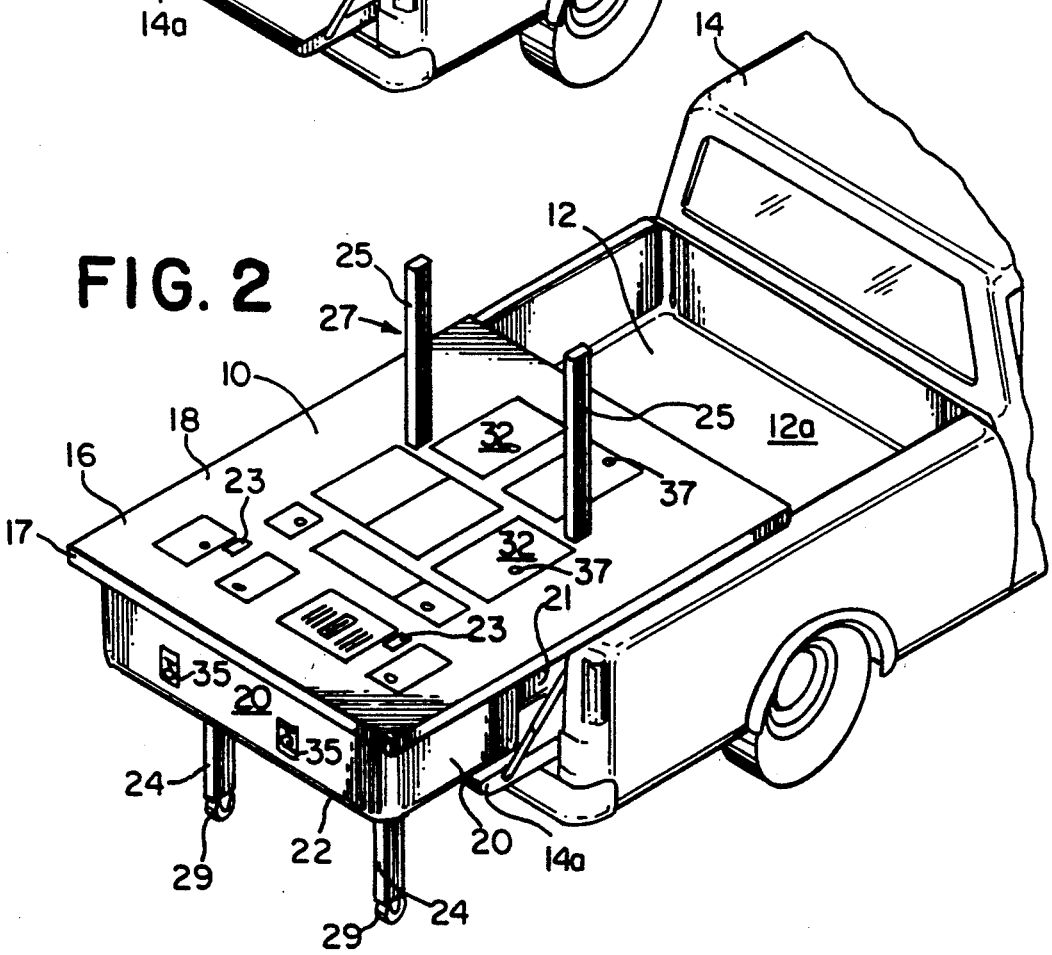
FIG. 2 is a perspective view of the portable work table of FIG. 1 in which the portable work table is partially removed from the storage compartment of the vehicle.
Figure 3:
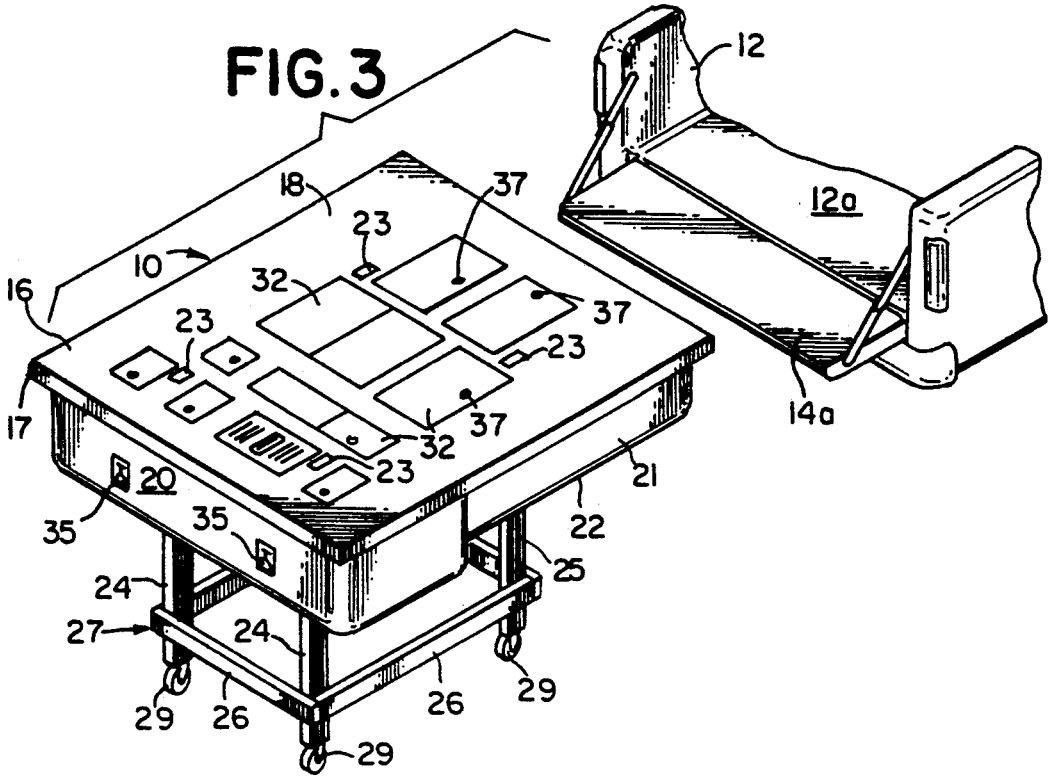
FIG. 3 is a perspective view of the portable work table of FIG. 1 entirely removed from the storage compartment of the vehicle.

Referring to the drawings, wherein like reference numerals indicate like elements throughout, there is shown in FIGS. 1-3 a work table 10 adapted for being removably positioned within a storage compartment 12 of a vehicle 14. In the preferred embodiment, the vehicle 14 is a pickup truck and the storage compartment 12 is the bed of the pickup truck. However, it is understood by those skilled in the art, that the vehicle 14 may be any suitable transport device such as, but not limited to, a trailer, a van or other type of freight truck.

Referring now to FIG. 1, the work table 10 is preferably portable and comprises a frame 16 which includes an upper wall 17 which has a generally planar top surface 18. The upper wall 17 is preferably constructed of wood, such as plywood. However, it is to be understood by those skilled in the art that any suitable material may be used such as, but not limited to, a plastic or metal without departing from the scope and spirit of the present invention. When the work table 10 is placed within the storage compartment 12 of the vehicle 14, the top surface 18 of the frame 16 is visible.

Referring to FIGS. 2 and 3, side walls 20 extend downwardly from the upper wall 17 and a bottom wall 22 extends between the distal ends of the side walls 20 thereby forming the frame 16. The two longitudinal side walls 20 preferably include an indentation 21 for providing clearance for the wheel well of the vehicle 14. The side walls 20 and bottom wall 22 of the frame 16 are preferably formed of a plastic such as, but not limited to, polyvinyl chloride (PVC) or acrylonitrile butadiene styrene (ABS). It is understood by those skilled in the art that the side walls 20 and bottom wall 22 may be made from any suitable material such as, but not limited to, plastic, wood or metal without departing from the scope and spirit of the present invention. In the preferred embodiment, the side walls 20 and bottom wall 22 are formed as a single unit by vacuum molding. However, any suitable molding technique, such as injection molding, can be used without departing from the scope and spirit of the present invention.

Figure 7:
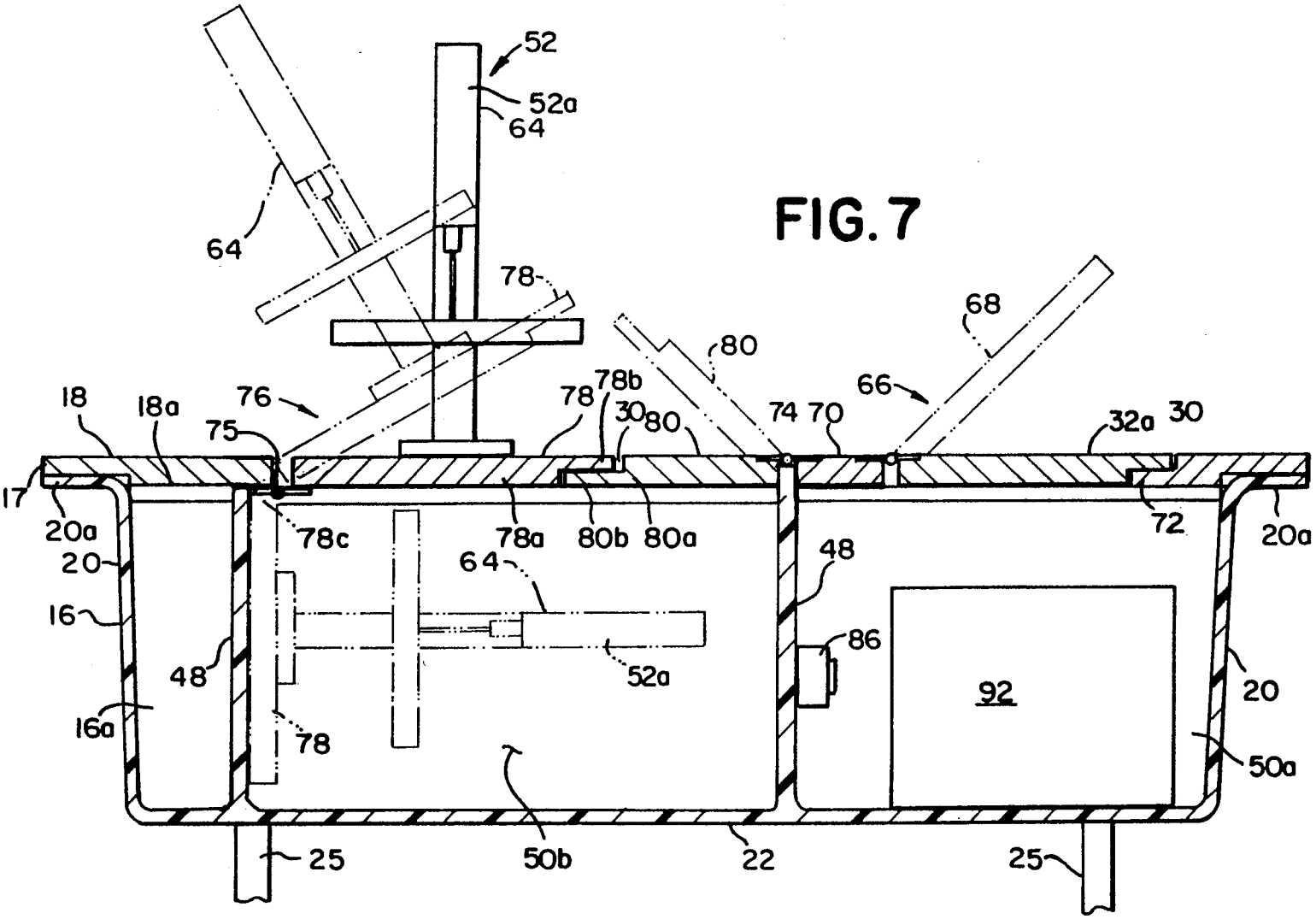
FIG. 7 is a cross-sectional view of the table shown in FIG. 4 taken along lines 7—7 of FIG. 4.

As best shown in FIG. 7, the upper ends of the side walls 20 preferably include an outwardly extending flange 20*a* for receiving the upper wall 17. The upper wall 17 is attached to the flanges 20*a* of the side walls 20 by securing means. In the present embodiment, it is preferred that the securing means be comprised of standard fasteners, such as nuts and bolts (not shown). However, it is understood by those skilled in the art that other securing means could be used, including, but not limited to, heavy duty nails and adhesives, without departing from the spirit and scope of the invention.

Figure 5:
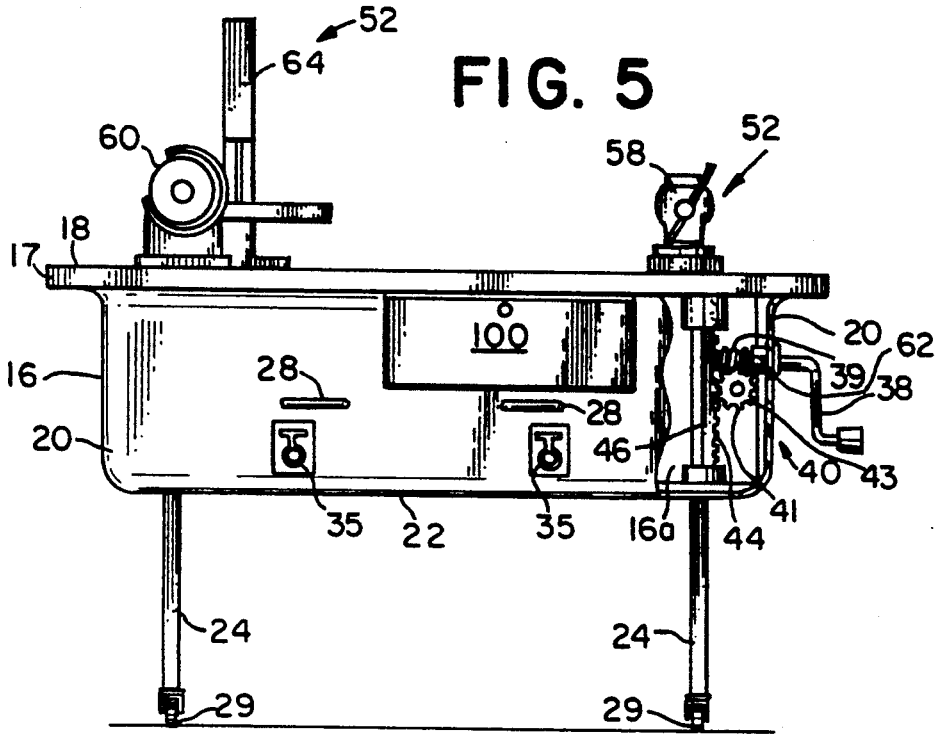
FIG. 5 is a partially broken away left elevational view of the portable work table of FIG. 1.
Figure 8:
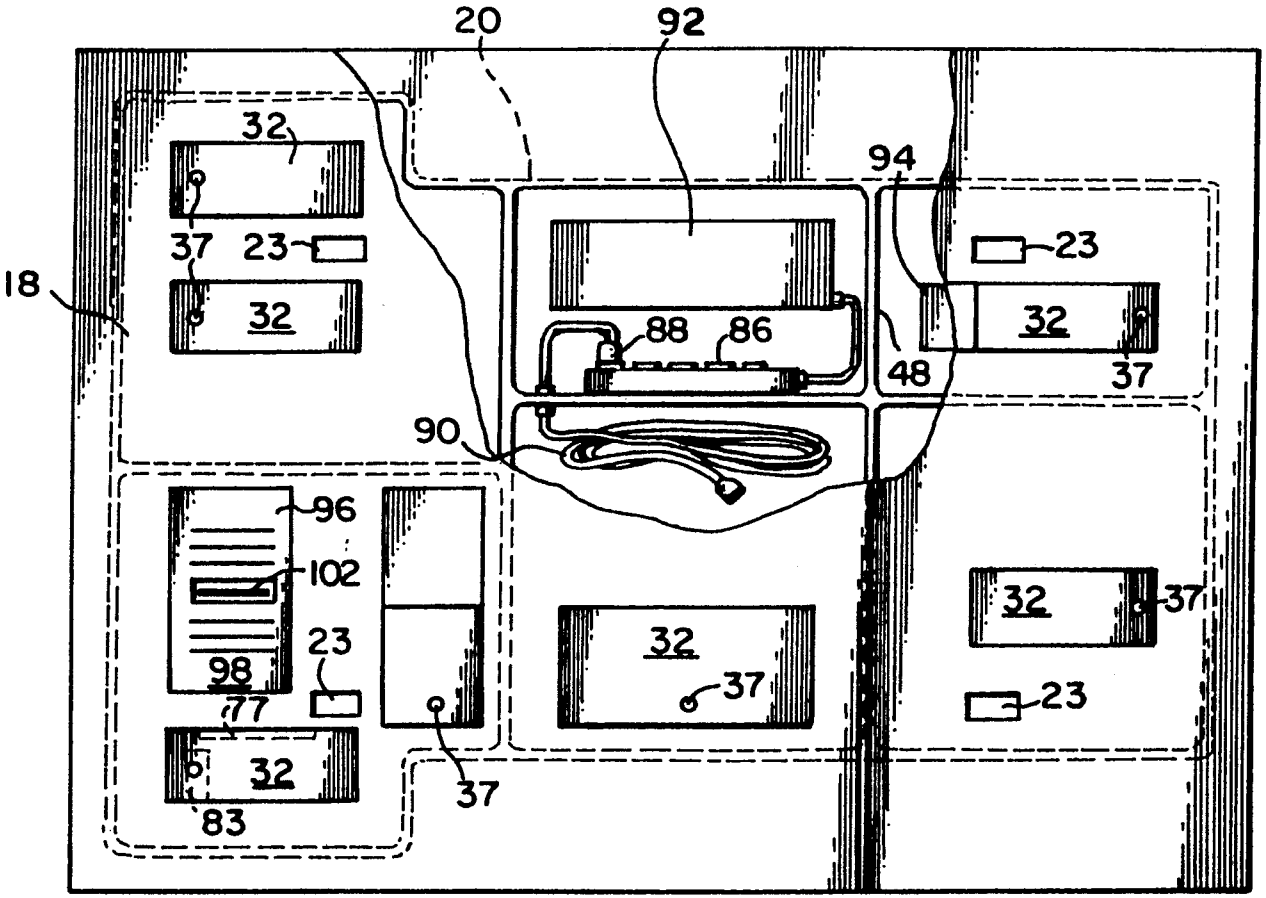
FIG. 8 is a partially broken away top plan view of the work table of FIG. 1 showing a portion of the interior thereof.

Referring now to FIGS. 5, 7 and 8, the upper, bottom and side walls 17, 20, 22 define a generally hollow interior 16*a*. The frame 16 is generally in the form of a parallelpiped and is sized to be easily received within the storage compartment 12 of the vehicle 14. The dimensions of the frame 16 can be designed to fit any suitable storage compartment 12 of any size vehicle. However, it is preferred that the frame 16 generally complement the storage compartment 12 to prevent the work table 10 from sliding within the compartment during travel. Extendable locking pins (not shown) could extend outwardly from the longitudinal side walls 2 into the walls of the storage compartment 12 to prevent the work table 10 from inadvertently sliding out of the storage compartment during travel. Alternatively, where the table 10 is smaller than the storage compartment 12, the work table 10 could be secured within the storage compartment by standard methods, such as rope.

Referring now to FIGS. 1-3, a plurality of legs 27, in the preferred embodiment four legs arranged in a first set or pair of legs 24 and a second set or pair of legs 25, are movably mounted within the frame 16. In the preferred embodiment, each leg 27 is slideably received through a suitably sized opening 23 within the frame 16 of the work table 10. In the preferred embodiment, each opening 23 extends through the bottom wall 22, hollow interior 16*a* and upper wall 17 of the frame 16.

Each leg 27 is independently and separately movable between first (FIG. 1) and second (FIG. 3) positions on the frame 16. In the first position, the leg 27 extends from the bottom wall 22 of the frame 16 for being engaged with a support surface (not shown), such as the ground, such that the frame 16 is positioned above the support surface to permit work to be readily carried out on the top surface 18. That is, each leg 27 is placed in the first position when the work table 10 is removed from the storage compartment 12 so that the work table 10 is self-supported. In the second position each leg 27 is retracted from the first position towards the bottom wall 22 until each leg 27 extends from the top surface 18 of the work table 10 such that the work table 10 is positionable within the storage compartment 12 of the vehicle 14 with the bottom wall 22 in close facing relationship with the floor 12*a* of the storage compartment 12. While it is preferred that the legs 27 extend above the top surface 18 of the frame 16 in the second position, it is understood by those skilled in the art that legs 27 could merely retract into the hollow interior 16*a* in the second position. Such a function could be accomplished by telescoping legs (not shown).

Figure 6:
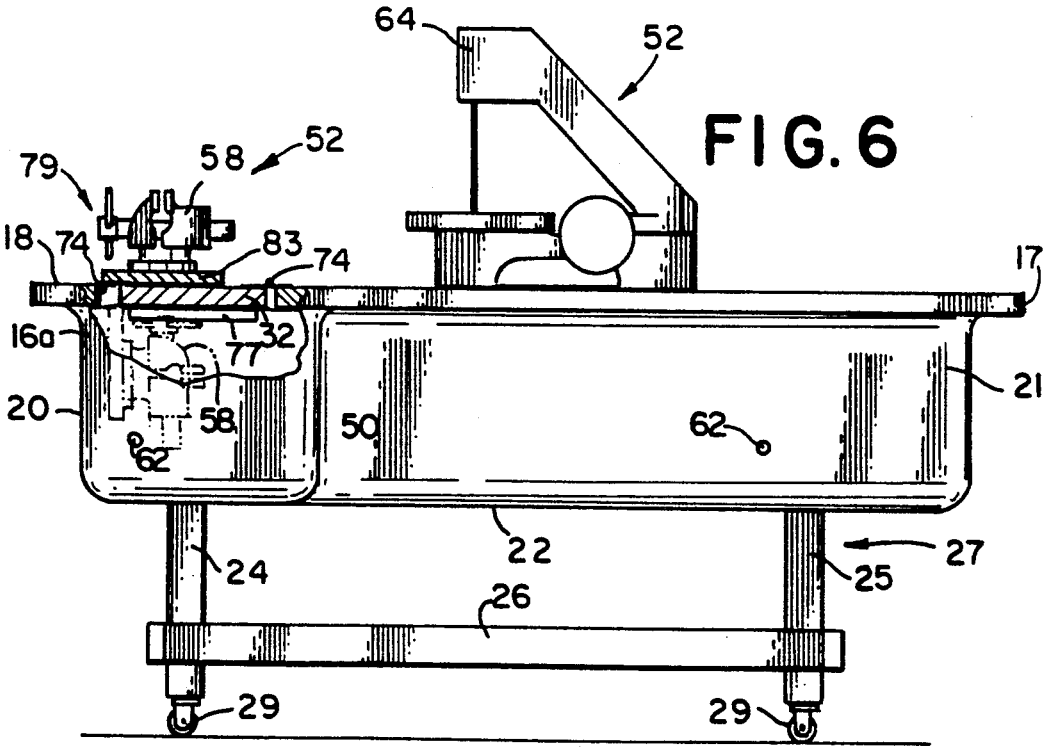
FIG. 6 is a front elevational view, partially in cross section, of the portable work table of FIG. 1.

Referring now to FIGS. 1, 3 and 6, whether the legs 27 are in the first or second position, support boards 26 are attachable to the distal portion of each set of legs 24, 25 by any suitable means, such as screws, in order to provide structural support to the legs 27. When in the second position, the legs 27 and support boards 26 extend a sufficient distance above the top surface 18 to store and secure additional objects (not shown), such as supplies, ladders, or other bulky tools on top of the frame 16 while the work table 10 is being transported within the vehicle 14. To assist in the storing of such objects, tie down rings 35 are provided on the lateral side walls 20 for securing the objects placed on top of the work table 10.

Referring now to FIG. 5, there is shown means for independently moving each leg 27 between the first and second positions. In the present embodiment, the means for moving is preferably a rack and pinion mechanism 40 which is used to raise and lower each leg 27 within the frame 16 of the work table 10. A crank arm 38 is inserted through an opening 62 located in the corresponding longitudinal side wall 20 of the frame 16. The crank arm 38 has a worm gear 39 rotatably mounted within the interior of the frame 16. The worm gear 39 is threadably engaged with a complementary spur gear 41 having a plurality of gear teeth 43. The gear teeth 43 of the spur gear 41 are threadably engaged with a series of teeth 44 located on a rack 46 which is directly secured to the leg 27. As the crank 38 is turned in a given direction, the worm gear 39 engages the gear teeth 43 and causes the gear 41 to rotate. The gear teeth 43 in turn engage the rack teeth 44 thereby causing the rack 46 and associated leg 24 to move in a vertical direction. The direction in which the crank arm 38 is rotated, i.e., clockwise or counterclockwise, determines the direction of movement of the leg 24, i.e., up or down. When the leg 24 is placed in the desired position, the leg 24 remains locked in the desired position since the rack and pinion mechanism 40 is self locking.

While in the present embodiment it is preferred that each leg 27 be moved by a rack and pinion mechanism, it is understood by those skilled in the art that other devices could be used to move each leg 27 between the first and second positions, without departing from the spirit and scope of the invention. For instance, the legs 27 could manually be lifted and locked in place with lock pins (not shown), a crank and chain drive mechanism could be used in combination with the lock pins (not shown) or a hydraulic lift system could be used (not shown).

During travel and outside storage, a liquid impervious cover (not shown), such as vinyl-backed canvas, may be placed over the top surface 18 of the frame 16 to prevent objects stored within the frame 16 from incurring water damage. In the preferred embodiment, the cover is attached to the top surface 18 of the work table 10 by a plurality of male/female snaps, as is understood by those skilled in the art. However, any suitable fastening means may be used without departing from the scope and spirit of the present invention.

Referring to FIGS. 2 and 5, when the work table 10 is to be removed from the storage compartment 12 of the vehicle 14, as discussed in more detail hereinafter, handles 28, which are mounted to the lateral side walls 20, are grasped to assist in removing the work table 10 from the storage compartment 12. In the present embodiment, the handles 28 are preferably retracted when not in use to be contained within the side wall 20, however, any suitable handles could be used without departing from the scope and spirit of the present invention.

In the preferred embodiment, wheels 29 are located on the lower portion of each leg 27. When the legs 27 are in the second position, the wheels 29 protrude from the bottom wall 22 of the frame 16. The work table 10 is preferably moved by rolling the wheels 29 located beneath the frame 16 along the floor 12*a* of the storage compartment 12. Similarly, the wheels 28 promote the portability of the work table 10 when the legs 27 are in the first position.

Figure 4:
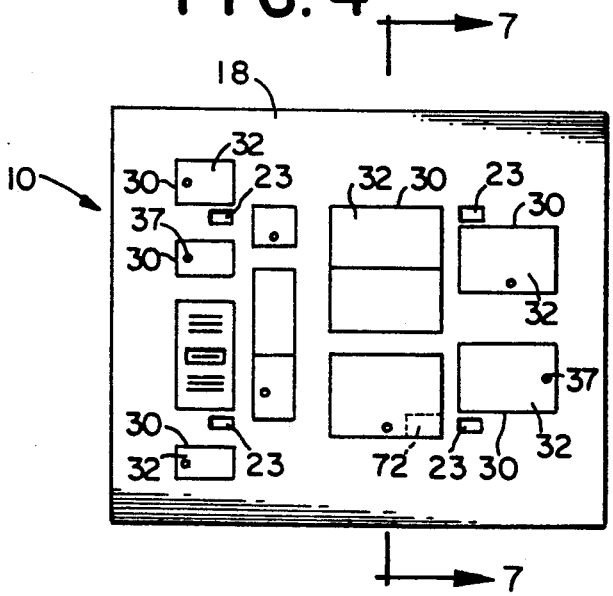
FIG. 4 is a top plan view of the portable work table of FIG. 1.

Referring now to FIGS. 4 and 6, there is shown a top plan view of the work table 10. A plurality of objects (generally designated 52) are movably mounted on the frame 16 of the work table 10, as described in further detail hereinafter. In the preferred embodiment, the objects 52 are tools such as, but not limited to, electrically powered tools, air powered tools, manually operated tools and any other supplies necessary to perform a given task. It is to be understood that the work table can be equipped with any type of tooling or equipment, such as, but not limited to, plumbing equipment, electrical equipment, construction equipment or any type of service equipment which may be transported. Specifically, a work table 10 designed to contain tools for construction may include the following: a mitre-saw, table saw, generator, welder, flood lamp, wash basin, grinder, band saw, drill press, vise, air compressor, a retractable extension cord, a retractable power cord, hose, fire extinguisher, shop vacuum, emergency pump, utility hooks and a storage compartment for hand tools. The work table 10 may also include a vacuum source (not shown).

Referring now to FIGS. 5–7, storage means is interconnected between the frame 16 and one or more of the objects 52 for allowing each object 52 to move with respect to the top surface 18 of the frame 16 between a first position wherein the object 52 is positioned within the interior 16*a* of the frame 16 below the top surface 18 (shown in phantom in FIG. 7) and a second position wherein the object 52 is positioned at least partially above the top surface 18 of the frame 16 (as shown in solid lines in FIG. 7).

Referring now to FIGS. 7 and 8, the storage means preferably comprises a plurality of partitions 48 located within the hollow interior 16*a* of the frame 16 which form a plurality of compartments 50, each for receiving one of the objects 52. In the present embodiment, the partitions 48 are comprised of a series of walls extending downwardly from the upper wall 17 which provide added strength to the frame 16 of the work table 10. The partitions 48 are preferably constructed of the same material as the upper wall 17. However, it is understood by those skilled in the art that the partitions 48 could be constructed of other materials, such as plastic or cardboard. In the present embodiment, the partitions 48 are preferably secured to the upper wall 17 by standard fasteners (not shown), such as screws. Moreover, it is also understood by those skilled in the art that the partitions 48 could extend upwardly from the bottom wall 22 and inwardly from the side walls 20 and be formed as an integral part of the same. In such an event, the partitions 48 would be molded as one piece with the bottom and side walls 22, 20.

It is understood by those skilled in the art that the partitions 48 could be selectively removable from the hollow interior 16*a* of the frame 16. In this way, the partitions may be arranged in any desired manner depending upon the equipment which is to be kept within the frame 16. Therefore, the partitions 48 could be entirely omitted without departing from the scope and spirit of the invention. The partitions could be removably attached to the hollow interior of the frame 16 by suitable fastening means such as, but not limited to, grooves within the frame 16 in which the partitions 48 may be slideably attached or some type of indentations formed on the frame 16 in which the partitions 48 may be snapped. In addition, releasable fasteners (not shown) may be mounted on the partitions 48 so that one or more partitions may be fastened together. The compartments 50 may be entirely formed by the partitions 48 or by a combination of the partitions 48 and one or more of the side walls 20 of the frame 16.

It is preferred that the storage means further comprises a corresponding plurality of apertures 30 in the upper wall 17 aligned with the compartments 50 for accessing the objects 52 within the respective compartments 50. The storage means also includes a plurality of plates 32 releasably received within each aperture 30 such that each plate 32 is removable from each aperture 32 to access the compartments 50. The plates 32 are preferably made from the same material as the upper wall 17 and are of generally the same thickness. In the present embodiment, it is preferred that the plates 32 be releasably secured within the apertures 30 in at least three different arrangements.

Referring now to FIG. 7, in the first arrangement 66, a plate 32*a* is pivotally attached to the top surface 18 of the frame 16 by a standard hinge 70. In the closed position the plate 32*a* is in the same plane as the upper wall 17 of the table 10 and is sized to complement the aperture 30. A small tab 72 extends from the upper wall 17 into the aperture 30 in which the plate 32*a* is received to support the same and prevent the plate 32*a* from entering the compartment 50*a*. Each plate includes a finger hole 37 for grasping and lifting the plate 32 to an open position to thereby access an object 52, such as a generator 92, within the compartment 50*a*. It is understood by those skilled in the art that the hinge 70 could be omitted and additional tabs 72 (not shown) could be used to allow the plate 32 to merely rest within the aperture 30. It is also understood by those skilled in the art that the present invention is not limited to storing any particular object 52 within the compartment 50*a*. For instance, a fire extinguisher or hand tools (not shown) could be stored therein.

In the present embodiment, it is preferred that storage means further includes a support means interconnected between the frame 16 and the object 52 for allowing each object 52 to move with respect to the frame 16 between a first position (shown in phantom in FIG. 7) wherein the object 52 is positioned within the compartment 50 below the top surface 18 and a second position (shown in solid lines in FIG. 7) wherein the object is positioned at least partially above the top surface 18 of the frame 16. In the second and third arrangements, the plates 32 cooperate with the storage means to assist in storing the objects 52, as described in more detail hereinafter.

With reference to FIG. 7, in the second arrangement 76 of the present embodiment, it is preferred that the support means be comprised of a first board 80 which is pivotally mounted to the top surface 18 of the upper wall 17 at the periphery of the aperture 30 by a standard hinge 74. The hinge 74 permits the first board 80 to assume a first position within the aperture 30 where it is generally coplanar with the upper wall 17 and a second position wherein the first board 80 pivots away from the upper wall 17 to a generally vertical position (not shown) above the upper wall 17. The first board 80 is prevented from pivoting downwardly into the compartment due to interference caused by the partition 48.

The support means further comprises a second board 78 which is hingedly connected to the upper wall 17 at a position opposite from the first board 80 by a standard hinge 75. It is preferred that the second board 78 be hingedly connected to the bottom surface 18*a* of the upper wall 17. The distal ends 80*a*, 78*a* of the first and second boards 80, 78 include a flange 78*b*, 80*b* extending therefrom, respectively. Each flange 78*b*, 80*b* is approximately one-half the thickness of each board 78, 80 to permit the same to be placed in an overlapping relationship when the object 52 is placed in the second position. That is, the first board 80 supports the second board 78 in the second or horizontal position because of the interference caused by the partition 48.

When the second board 78 is positioned downwardly within the compartment 50*b*, a plate (not shown) is positioned within the opening defined by the aperture 30 and the first board 80. That is, the plate is located over the proximal end 78*c* of the second board 78 and the flange 80*b* of the first board 80. The portion of the plate which overlaps the flange 80*b* of the first board 80 also includes a complementary flange to provide a flat work surface when the object 52 is placed in the first or stored position.

As shown in FIG. 7, it is preferred that the object 52 be a band saw 52*a* which is secured to the second board 78 by securing means. In the present embodiment, it is preferred that the securing means be comprised of standard fasteners, such as nuts and bolts. As mentioned above, any type of object 52 or tool, such as a drill press, could be secured to the second board 78 without departing from the spirit and scope of the invention.

To place the band saw 52*a* in the second or usable position, the plate is lifted from the aperture 30 and the first board 80 is pivoted upwardly away from the compartment 50 such that it rests on the upper wall 17 over the adjacent compartment 50*a*. This allows the second board 78 and band saw 52*a* to be pivoted upwardly through the aperture 30 until it has reached a position above the top surface 18 (shown in phantom) which allows the first board 80 to be pivoted back towards the compartment 50. When the first board 80 is repositioned within the aperture 30, the first board 78 and band saw 52*a* are then pivoted downwardly such that the flanges 78*b*, 80*b* are in engagement and the object 52 is strongly supported on the upper wall 17. To place the band saw 52*a* back in the first or storage position, the same procedure is followed except in the reverse order.

Referring now to FIG. 6, in the third arrangement 79, it is preferred that the support means comprise a third board 83 which is pivotally secured to the top surface 18 of the upper wall 17 at one end of the aperture 30 for allowing the third board 83 to pivot with respect to the upper wall 17 between a first position wherein the third board 83 is positioned within the compartment 50 in a generally vertical position (shown in phantom) and a second position wherein the third board 83 is positioned above the top surface 18 of the upper wall 17 and extends generally parallel thereto. For purposes of this description only, the object 52 is a vise 58 which is secured to the third board 83 generally in the same manner that the band saw 52*a* is secured to the second board 78. However, as mentioned previously, the present invention is not limited to securing any particular object 52, to the third board 83. For instance, a grinder (not shown) could be secured to the third board 83. In the third arrangement 79, the plate 32 is pivotally secured to the upper wall 17 at the top surface 18 at a position opposite from the pivotal connection of the third board 83. In the present embodiment, it is preferred that the plate 32 and third board 83 be pivotally secured to the upper wall 17 by a standard hinge 74 secured to the top surface 18.

As best shown in FIGS. 4 and 8, a flange 77 extends inwardly from one edge of the aperture 30 for receiving the plate 32 when the plate is positioned therein. The flange 77 supports the plate 32 and third board 83 when the same are in the second or usable position. The third board 83 is slightly narrower than the width of the aperture 30 to permit the third board 83 to clear the flange 77 during pivotal motion. When the board 83 and the vise 58 are in the first or storage position within the compartment 50, the plate 32 is again positioned in engagement with the flange 77.

To place the vise 58 in the second or usable position, the plate 32 is lifted upwardly away from the compartment 50 such that it rests on the upper wall 17 over the adjacent compartment to permit the third board 83 to pivot upwardly out of the compartment 50. The third board 83 is pivoted completely out of the compartment 50 to permit the plate 50 to be pivoted back down toward the compartment 50 into engagement with the flange 77. Once the plate 32 is in engagement with the flange 77, the third board 83 and vise 58 can then be pivoted towards the plate 32 for support thereof as shown in solid lines in FIG. 6. To place the vise 58 back in the first or storage position, the same procedure is followed except in the reverse order.

While it is preferred that the present invention use the above-described three arrangements 66, 76, 79 for supporting the plate 32, it is understood by those skilled in the art that other methods could be utilized to permit access to the compartments 50. For instance, the plates 32 could be slideably disposed within a slot in the center of the upper wall 17 to thereby permit the apertures 30 to be closed by sliding each plate across the same. The present invention is not limited to the use of any particular type of arrangement for securing the objects 52 within the compartments 50. That is, the various compartments 50 of the work table 10 can include the first type of arrangement 66 exclusively, the second type of arrangement 76 exclusively, the third type of arrangement 79 exclusively or any combination thereof, without departing from the spirit and scope of the invention.

Referring now to FIGS. 4, 5 and 8, it is also understood by those skilled in the art that the plates 32 could be entirely omitted and that an object 52 can be complementarily positioned within a compartment 50. For instance, a table saw 96 could be positioned within one compartment such that the working surface 98 of the table saw 96 is generally coplanar with the top surface 18 of the upper wall 17. An access panel 100 is hingedly positioned within the lateral side wall 20 which is proximate the table saw 96 to permit a worker to access the mechanism for raising and lowering the blade 102 of the table saw 96.

Referring now to FIG. 8, there is shown a cross-sectional view of the interior of the frame 16. As discussed above, contained within the frame 16 are a plurality of partitions 48 which section the interior of the frame 16 into a plurality of compartments 50. Each compartment 50 can contain an object 52 such as, but not limited to, a power tool. As is known to those skilled in the art, in order for the power tool to operate, it must be supplied with power. One or more power strips 84 (only one is shown) are mounted to the interior surface of the bottom wall 22 of the frame 16. The power strips 84 comprises a plurality of outlets 86 for receiving plugs 88 from various electrical objects which may be contained within the work table 10. The power strips 84 are connected to an extension cord 90 which can be connected to a suitable power source (not shown), such as an AC main or house current supply. In the preferred embodiment, the extension cord 90 is retractable for easy storage. However, any suitable extension cord 90 may be used without departing from the scope and spirit of the present invention.

In addition, a generator 92 is located within one of the compartments 50 of the frame 16 for supplying power to the electrical objects contained within the work table 10 when a permanent power source is not available. The generator 92 is preferably a 1000 W generator. However, any suitable generator can be used without departing from the scope and spirit of the present invention.

An alarm (not shown) can be installed in the work table 10 to protect vandalism or theft. The alarm 94 can be any suitable type of alarm such as, but not limited to, a vibration alarm, although other types of alarms could be used without departing from the scope and spirit of the present invention. The work table 10 can also include an air compressor 94 in one of the compartments 50 for powering air tools, such as an air drill (not shown). The air compressor includes an air hose for attaching the air compressor to a tool.

To remove the work table 10 from the storage compartment 12, the gate **14*a* is folded down and the worker grasps the handles 28 and pulls the work table 10 outwardly until a portion of the work table 10 has been removed from the storage compartment 12 of the vehicle 14. That is, when the first pair of legs 24 clear the leading edge of the gage 14*a*, the legs 24 are slideably repositioned by the rack and pinion mechanism 40 from the second position in which the legs 24 extend from the top surface 18 of the frame 16 to the first position so that the first set of legs 24 extend from the bottom surface 22 of the frame 16. If the support boards 26 are in use, it is necessary to first remove the same in order to move the legs 27 between the first and second positions. The work table 10 at this point is partially supported by the storage compartment 12 and partially supported by the first set of legs 24, as shown in FIG. 7**.

Referring to FIG. 3, the work table 10 is then further removed from the storage compartment 12 of the vehicle 14 until only a small portion of the bottom wall 22 of the work table 10 is supported by the gate **14*a*. The second set of legs 25 is then slideably repositioned by the rack and pinion mechanism 40 from the second position to the first position such that the second set of legs 25 extend from the bottom surface 22 of the frame 16. The work table 10 is then completely removed from the storage compartment 12 and moved to the work area. As mentioned above, each leg 27 includes a wheel 29 for allowing easy movement of the work table 10**.

Once the work table 10 is in a preferred location near a current source, such as an AC main, the extension cord 90 is plugged into the outside current source. If no outside current source is available, the extension cord 90 is plugged into the generator 92 located within one of the compartments 50 of the work table 10. The tools or other objects 52 which are to be used are then removed from the compartments 50 by removing the cover plates 32 to place the same in the second position, as discussed above. While the work table 10 is in use, the vehicle is free to carry out other functions. Once the task(s) has been completed, the objects 52 are then placed in the first or storage position and the work table 10 is repositioned within the storage compartment 12 by merely reversing the steps taken to remove the work table 10 from the storage compartment 12.

An alternate embodiment (not shown) of the work table 10 is designed to carry bulk items such as, but not limited to, dirt or stones or any suitable type of objects, such as bags of groceries or hardware materials. In the alternate embodiment, the work table 10 comprises a frame 16 and four legs 27 similar to that of the preferred embodiment and as such will not be described in detail. An aperture (not shown) is located in the upper wall 17 of the frame 16 which exposes a substantial portion of the hollow interior **16*a* of the frame 16. It is to be understood by those skilled in the art that the aperture may be of any desired size without departing from the scope and spirit of the present invention. The aperture is preferably generally rectangularly shaped and provides easy access to the interior 16a of the frame 16**.

The aperture receives a pair of complementary plates (not shown) which are releasably secured within the aperture. It is to be understood by those skilled in the art that any number of plates can be received by the aperture. The plates are preferably made from the same material as the upper wall 17 of the frame 16 and are generally of the same thickness. The plates are preferably generally rectangularly shaped and a longitudinal edge of each plate is preferably attached to the longitudinal edges of the aperture in the upper wall 17 by hinges (not shown). However, it is understood by those skilled in the art that any suitable means may be used to releasably attach the plates to the upper wall 17. A pair of tabs (not shown) extend from each lateral edge of the aperture approximately equidistant from each longitudinal edge of the aperture on which each plate is received to support the same in a generally co-planar position and to prevent the plates from entering the interior 16a of the frame 16. The hinges allow the plates to move from a closed position in which the plates are received by the aperture and a open position in which the plates are lifted from the aperture and pivoted upwardly away from the frame 16. Finger holes (not shown) are provided on each plate for grasping and lifting the plate to an open position to thereby access objects located within the interior 16a of the frame 16.

The interior 16a of the frame 16 may be organized as one large compartment 50 or may be partitioned to provide a plurality of compartments 50, as in the preferred embodiment. The partitions also provide additional structural strength to the frame and act to separate objects located within the interior of the frame. The partitions may be arranged in any suitable manner and the number of partitions contained within the frame is arbitrary.

A second aperture (not shown) is located on at least one of the lateral side walls 20 of the frame 16. The aperture is preferably sized to expose a substantial portion of the interior 16a of the frame 16. A side plate (not shown) is received by the aperture and pivotally attached thereto so that the interior 16a of the frame 16 may be accessed. A lock or latch (not shown) is located within the plate to secure the plate within the aperture. The plate is movable between a closed position in which the plate is located within the aperture and an open position in which the plate is lifted from the aperture and pivoted away from the frame 16. A finger hole (not shown) is located within the side plate to allow the side plate to be easily grasped. The side plate is used to easily remove objects contained within the frame 16 by opening the door or gate 14a to the storage compartment 12 of the vehicle 14 to access the side plate.

In another alternative embodiment, a coal bin type feeder (not shown) can be located within the bottom wall 22 of the frame 16 for releasing fluid materials (e.g., sand, dirt and coal) therefrom. In the case where the frame is transporting bulk items, such as dirt or stones, the coal bin feeder can be used to expel the items at a particular site. A handle associated with the coal bin feeder may be attached to one of the lateral side walls of the frame in order to provide easy access to the feeder. When the work table has been removed from the storage compartment and placed over the desired site to release its contents, the handle may be accessed thereby causing the feeder to open and the contents within the frame to be expelled.

From the foregoing description, it can be seen that the present invention comprises a portable work table adapted for being removably positioned within a storage compartment of a vehicle. It will be appreciated by those skilled in the art that changes could be made to the embodiment described above without departing from the broad inventive concepts thereof. It is understood, therefore, that this invention is not limited to the particular embodiment disclosed, but it is intended to cover all modifications which are within the scope and spirit of the invention as defined by the appended claims.

We claim:

1. A portable work table adapted for being removably positioned within a storage compartment of a vehicle comprising:

a frame comprising an upper wall having a generally planar top surface, side walls extending from said upper wall and a bottom wall extending between said side walls, said upper, bottom and side walls defining a generally hollow interior;

a plurality of legs movably mounted on said frame, said legs being movable between a first position wherein said legs extend from said bottom wall for being engaged with a support surface such that the frame is self-supported above said support surface to permit work to be readily carried out on said top surface and a second position wherein said legs are retracted from said first position towards said bottom wall such that said frame is positionable within the storage compartment of said vehicle;

a plurality of objects movably mounted on said frame; and storage means interconnected between said frame and each of said objects for allowing each object to move with respect to said top surface of said frame between a first position wherein the object is positioned within the interior of said frame below said top surface and a second position wherein the object is positioned at least partially above the top surface of said frame.

2. A portable work table according to claim 1, further including mechanical drive means for moving said legs between the first and second positions.

3. A portable work table according to claim 1, wherein at least one of said objects is a power tool.

4. A portable work table according to claim 3, further comprising power means positioned on said frame for supplying power to the power tool.

5. A portable work table according to claim 4, wherein said power means comprises at least one electrical outlet electrically attached to a power source.

6. A portable work table according to claim 5, wherein said power source is an AC main source.

7. A portable work table according to claim 5, wherein said power source is a generator located on said frame.

8. A portable work table according to claim 5, wherein said power means comprises an air compressor, said air compressor being located on said frame.

9. A portable work table according to claim 1, wherein at least two of the legs are positioned inwardly of the side walls a distance sufficient for allowing the bottom wall to receive a portion of the vehicle between the at least two legs and the side walls.

10. A portable work table adapted for being removably positioned within a storage compartment of a vehicle comprising:

a frame comprising an upper wall having a generally planar top surface, a plurality of side walls extending from said upper wall, and a bottom wall extending between said side walls, said upper, bottom and side walls defining a generally hollow interior;

a plurality of legs movably mounted on said frame, said legs being movable between a first position wherein said legs extend from the bottom wall for being engaged with a support surface such that the frame is positioned above said support surface to permit work to be readily carried out on said top surface, and a second position wherein said legs are retracted from said first position towards said bottom wall such that said frame is positionable within the storage compartment of the vehicle;

a plurality of objects movably mounted on said frame;

a plurality of partitions positioned within said hollow interior of said frame, said partitions forming a plurality of compartments within said frame each for receiving one of the plurality of objects, said upper wall including a corresponding plurality of apertures generally aligned with said compartments for accessing said objects within said compartments;

a plurality of plates being releasably received within each aperture such that each plate is removable from each aperture to access said compartments; and support means being interconnected between said frame and at least one of said objects for allowing said at least one object to move with respect to said frame between a first position wherein the object is positioned within said compartment below said top surface and a second position wherein the object is positioned at least partially above the top surface of the frame.

11. A portable work table according to claim 10, wherein at least one of said objects is a power tool.

12. A portable work table according to claim 10, further comprising power means positioned on said frame for powering said objects located within said frame, said power means including at least one electrical outlet attached to a power source.

13. A portable work table according to claim 12, wherein said power source is a remote AC main source.

14. A portable work table according to claim 12, wherein said power source is a generator located on said frame.

15. A portable work table according to claim 12, wherein said power means comprises an air compressor located on said frame.

16. A portable work table adapted for being removably positioned within a storage compartment of a vehicle comprising:

a frame comprising an upper wall having a generally planar top surface, side walls extending from said upper wall and a bottom wall extending between said side walls, said upper, bottom and side walls defining a generally hollow interior;

a plurality of legs movably mounted on said frame, said legs being movable between a first position wherein said legs extend from said bottom wall for being engaged with a support surface such that the frame is positioned above said support surface to permit work to be readily carried out on said top surface and a second position wherein said legs are retracted from said first position towards said bottom wall such that said frame is positionable within the storage compartment of said vehicle;

a rack and pinion mechanism interconnected between said legs and said frame for moving said legs between the first and second positions;

a plurality of objects movably mounted on said frame; and storage means interconnected between said frame and each of said objects for allowing each object to move with respect to said top surface of said frame between a first position wherein the object is positioned within the interior of said frame below said top surface and a second position wherein the object is positioned at least partially above the top surface of said frame.

17. A portable work table adapted for being removably positioned within a storage compartment of a vehicle comprising:

a frame comprising an upper wall having a generally planar top surface, side walls extending from said upper walls and a bottom wall extending between said side walls, said upper, bottom and side walls defining a generally hollow interior;

a plurality of legs movably mounted on said frame, said legs being movable between a first position wherein said legs extend from said bottom wall for being engaged with a support surface such that the frame is positioned above said support surface to permit work to be readily carried out on said top surface and a second position wherein said legs are retracted from said first position towards said bottom wall such that said frame is positionable within the storage compartment of said vehicle and the legs are positioned above said bottom wall and extend from the top surface of the box frame, when said legs are in said second position said legs extending above said top surface a distance sufficient to support items placed on the top surface of the frame;

a plurality of objects movably mounted on said frame; and storage means interconnected between said frame and each of said objects for allowing each object to move with respect to said top surface of said frame between a first position wherein the object is positioned within the interior of said frame below said top surface and a second position wherein the object is positioned at least partially above the top surface of said frame.

* * * * *